US007909402B2

(12) United States Patent
Chu et al.

(10) Patent No.: US 7,909,402 B2
(45) Date of Patent: Mar. 22, 2011

(54) BACK SUPPORT FOR A SEAT

(75) Inventors: Zooey C. Chu, Grand Rapids, MI (US); Shun Jie Ju, Dong Guan (CN)

(73) Assignee: Synergy Product Development, Inc., Grand Rapids, MI (US)

( * ) Notice: Subject to any disclaimer, the term of this patent is extended or adjusted under 35 U.S.C. 154(b) by 288 days.

(21) Appl. No.: 12/211,453

(22) Filed: Sep. 16, 2008

(65) Prior Publication Data

US 2009/0236887 A1 Sep. 24, 2009

Related U.S. Application Data

(60) Provisional application No. 60/973,212, filed on Sep. 18, 2007.

(51) Int. Cl.
*A47C 3/00* (2006.01)
*A47C 7/02* (2006.01)
*A47C 7/14* (2006.01)

(52) U.S. Cl. ..... 297/284.3; 297/284.1; 297/284.2; 297/452.29

(58) Field of Classification Search ..... 297/284.1, 297/284.3, 296, 298, 452.15, 452.29, 452.3, 297/452.63
See application file for complete search history.

(56) References Cited

U.S. PATENT DOCUMENTS

| | | | | |
|---|---|---|---|---|
| 0,958,356 | A | | 5/1910 | Bode |
| 2,742,957 | A | | 4/1956 | Young |
| 2,756,809 | A | | 7/1956 | Endresen |
| 3,081,139 | A | | 3/1963 | Ridder |
| 3,112,137 | A | | 11/1963 | Drenth |
| 3,288,525 | A | | 11/1966 | Cerf |
| 3,565,482 | A | | 2/1971 | Blodee |
| 3,877,750 | A | | 4/1975 | Scholpp |
| 3,990,742 | A | | 11/1976 | Glass et al. |
| 4,462,635 | A | | 7/1984 | Lance |
| 4,585,272 | A | * | 4/1986 | Ballarini ..... 297/284.3 |
| 4,944,554 | A | | 7/1990 | Gross et al. |
| 4,993,164 | A | | 2/1991 | Jacobsen |
| 5,018,786 | A | | 5/1991 | Goldstein et al. |
| 5,062,676 | A | | 11/1991 | Mars |
| 5,320,410 | A | * | 6/1994 | Faiks et al. ..... 297/296 |
| 5,328,245 | A | * | 7/1994 | Marks et al. ..... 297/284.3 |
| 5,558,398 | A | | 9/1996 | Santos |
| 5,630,650 | A | | 5/1997 | Peterson et al. |
| 5,975,641 | A | | 11/1999 | Delesie |
| 6,045,185 | A | | 4/2000 | Ligon, Sr. et al. |
| 6,152,532 | A | | 11/2000 | Cosentino |
| 6,254,187 | B1 | | 7/2001 | Schuster, Sr. et al. |
| 6,309,018 | B1 | | 10/2001 | Jernstrom |
| 6,820,933 | B2 | | 11/2004 | Fereira Da Silva |
| 6,910,736 | B2 | | 6/2005 | White |
| 6,986,549 | B2 | | 1/2006 | Kniese |
| D527,557 | S | | 9/2006 | Reimers |
| 7,320,503 | B2 | | 1/2008 | Eysing |
| 2005/0184568 | A1 | * | 8/2005 | Schmidt et al. ..... 297/284.4 |

FOREIGN PATENT DOCUMENTS

| | | |
|---|---|---|
| EP | 0141652 | 5/1985 |

* cited by examiner

*Primary Examiner* — David Dunn
*Assistant Examiner* — Philip Gabler
(74) *Attorney, Agent, or Firm* — Kane & Co., PLC

(57) ABSTRACT

An self adjusting back support assembly for a seat is provided comprising a plurality of pivotally adjustable back support members juxtaposed one another such that each of said back support members is able to pivot about an axis contained wholly within an adjacent back support member allowing the back support assembly to adopt a serpentine contour substantially following a contour of an occupant's back.

37 Claims, 7 Drawing Sheets

BACK SUPPORT FOR A SEAT

CROSS REFERENCE TO RELATED APPLICATION

This application claims priority to U.S. Provisional patent application Ser. No. 60/973,212 filed Sep. 18, 2007, the contents of which are incorporated herein by reference.

BACKGROUND OF THE INVENTION

1. Field of the Invention

This invention relates to seating products such as seats and chairs, more specifically seating products having a back support that is adjustable to conform to the contour of the occupant.

2. Description of the Related Art

It is not uncommon for people to spend a substantial portion of their daily life sitting. As a result it is important that the seat be both safe and comfortable. One of the most important features of any seat is the manner in which it supports a user's back. If the seat provides inadequate support or supports the back in an improper position, the user is likely to become uncomfortable leading to an interruption in concentration, contribute to fatigue, poor posture, and even chronic back problems. On the other hand, a seat which provides the proper type of support may avoid, or even help to correct, such problems.

People are different in many respects, basic of which are size, shape, and strength. Because each person is unique, it is not uncommon that each person has a unique back support requirement. As a result, the ideal back support will vary from individual to individual.

Unfortunately, most seats have a back support designed for "the average individual." In an effort to produce more comfortable and healthy seating, some seats, particularly those commonly used in the office environment, offer a variety of adjustment features, such as the height and angle of the back support. Other offer front and back adjustment of the seat. Not all seat manufacturers provide a full complement adjustment options so that one seat can fit any user. Many adjustment features do not satisfy the demand requirements of the public to justify their implementation. Other adjustment options are simply too expensive to offer. As a result, such seats cannot provide everyone the proper fit and support.

Many attempts have been made to improve the comfort of seating products. For example, the seat described in U.S. Pat. No. 3,990,742 to Glass has a number of individual cam-like members extending laterally across the seat back. These members can be individually rotated to modify the shape of the back support. Although this type of system offers increased adjustability, it sacrifices convenience. Given the number of cam members that must be adjusted for each user, it is impractical for a variety of users to use such a seat. Another seat having a number of individually adjustable back support members is disclosed in U.S. Pat. No. 5,018,786. Again, given the large number of individual adjustments necessary to configure the seat to each user, this type of seat suffers the same disadvantages as that described immediately above.

Some seats offer automatic adjustment systems. For example, U.S. Pat. No. 4,944,554 to Gross employs a number of motors to automatically adjust the configuration of a seat to a predetermined spinal profile. However, the complicated electrical and mechanical interfaces required for this type of seat limit its reliability, availability, and practicality in many environments.

U.S. Pat. No. 5,328,245 discloses a seat having a seat and an upwardly extending support bar. A number of segments are received along the support bar to define a support surface for supporting the back of the user. The segments are slidable back and forth in a direction perpendicular to the user to allow the support surface to conform to the back of the seated person. A locking mechanism allows the person to lock the segments in the desired position. The disadvantage offered by this invention is that the contour is not truly conforming. Rather the contour is obtained by a series of step-like adjustments resulting in sharp transitions along the contour.

Each of the chairs and seats mentioned above has one or more disadvantages. Most of the seats described above provide a complex contouring mechanism for adapting to the user's back. That is to say that the contouring mechanisms are so time consuming or difficult to configure to the user's back that most user's will find them impractical. Others of the seat designs mentioned above offer complex systems for conforming to the back of the occupant resulting in substantially higher costs which translate directly to higher prices for consumers. As a consequence seating products available on the market today appeal to a limited audience and fail to meet the mass market attributes of the day.

BRIEF DESCRIPTION OF THE DRAWING FIGURES

FIG. 1 generally illustrates one type of seat having a back support assembly embodying the invention;

DETAILED DESCRIPTION OF THE VARIOUS EMBODIMENTS

Figure 1:
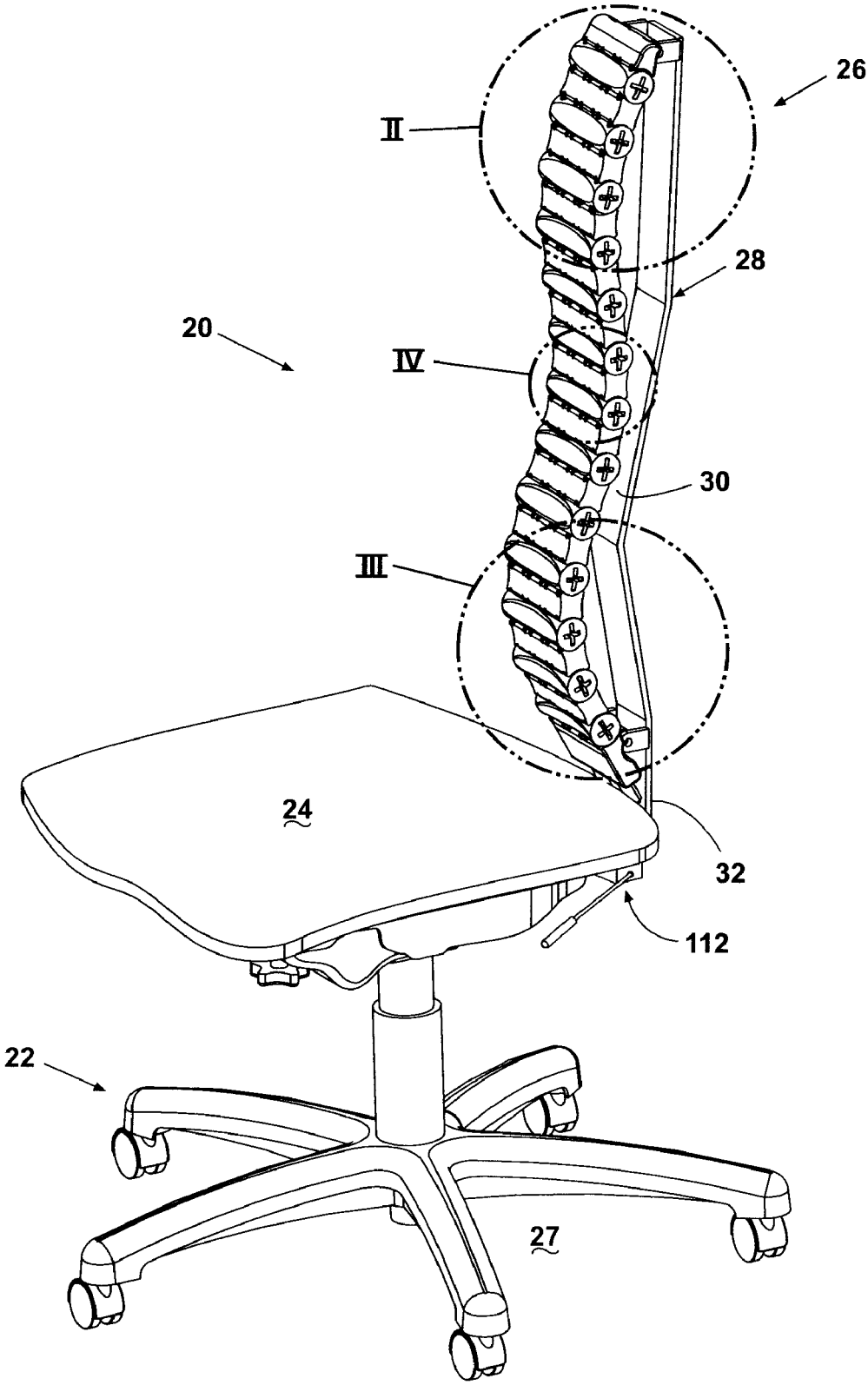

For purposed of the following description, the terms "upper", "lower", "right", "left", "rear", "front", "vertical", "horizontal" and derivatives thereof shall relate to the invention as oriented in FIG. 1. However, the invention may assume various alternative orientations except where expressly specified to the contrary. It is also to be understood that the specific devices and processes illustrated in the attached drawings, and described in the following specification, are simply exemplary embodiments of the inventive concepts defined in the specification and any appended claims. Specific dimensions and other physical characteristics relating to the embodiments disclosed herein are not to be considered limiting unless the claims expressly state otherwise.

The term 'seat' as used herein refers to something that may be sat on. The definition includes any place in which a person may sit. Such structures include, but are not limited to items of furniture for the home or office such as a chair, a stool, a sofa, a bench, and a lounge, and other forms used in other applications including seating for vehicles such as automobiles, water craft, aircraft and the like. The terms "seat back," "back support," and "back rest" as used herein refer to, but are not limited to, structures associated with the seat upon which a person may lean against while seated.

FIG. 1 generally illustrates a seat 20 comprising in general terms a base assembly 22 supporting a seat assembly 24. Attached to one of the base assembly 22 or the seat assembly 24 and extending upwardly there from is a back support assembly 26. The back support assembly 26 may be attached to one of the base assembly 22 or the seat assembly 24 in a manner that permits the user to adjust the tilt angle of the back support assembly 26 relative to the seat assembly 24. Other common place adjustments include the ability to adjust the tilt angle of the seat assembly 24 relative to the base assembly 22, the front and back position of the seat assembly 24 relative to the base assembly 22 and the back assembly 26, and of course the height of the seat assembly 24 above the floor 27.

FIGS. 1-4, it is anticipated that the back support assembly 26 can be easily and readily adjusted to conform to the contour of the user's back. The back support assembly 26 includes a frame assembly 28 comprising a frame member 30 manufactured from metal or other material offering substantial structural rigidity to keep the back support assembly 26 in an upright orientation. It is contemplated that plate or tubular steel or aluminum and alloys thereof may be used to build the frame member 30. Other suitable materials may also include wood and wood composites. In a preferred embodiment of the invention, the frame member 30 is generally J-shaped wherein the laterally extending bottom leg 32 may be coupled to one of the base assembly 22 or the seat assembly 24. Extending upwardly from one end of the lower leg 32 is a vertical leg 34 extending substantially the length of the back support assembly 26. The upper end 38 of leg 34 includes at least one and preferably two laterally extending flanges 40. Should two flanges 40 be used, it is preferred they be aligned with one another and extend from opposite sides of the vertical member 34 to form a yoke-like structure for reasons that will become readily apparent below. Should a single flange be preferred, it is desired that the flange extend laterally outward from a central portion of the vertical member 34. Regardless of the number of flanges 40, it is preferred that the distal end furthest from the upright 34 include a transverse hole 44 for receiving a bolt or other fastener. A similar yoke-like structure is also preferred to be formed toward the opposite and lower end of the vertical member 34, proximate the seat assembly 24. Shown in FIG. 4, two laterally extending flanges 42 extend from opposite sides of the vertical member 34. However, just as with the yoke-like structure described immediately above, it may be desired to use a single flange such as 42 extending laterally from a central portion of the one side of the vertical member 34.

Figure 3:
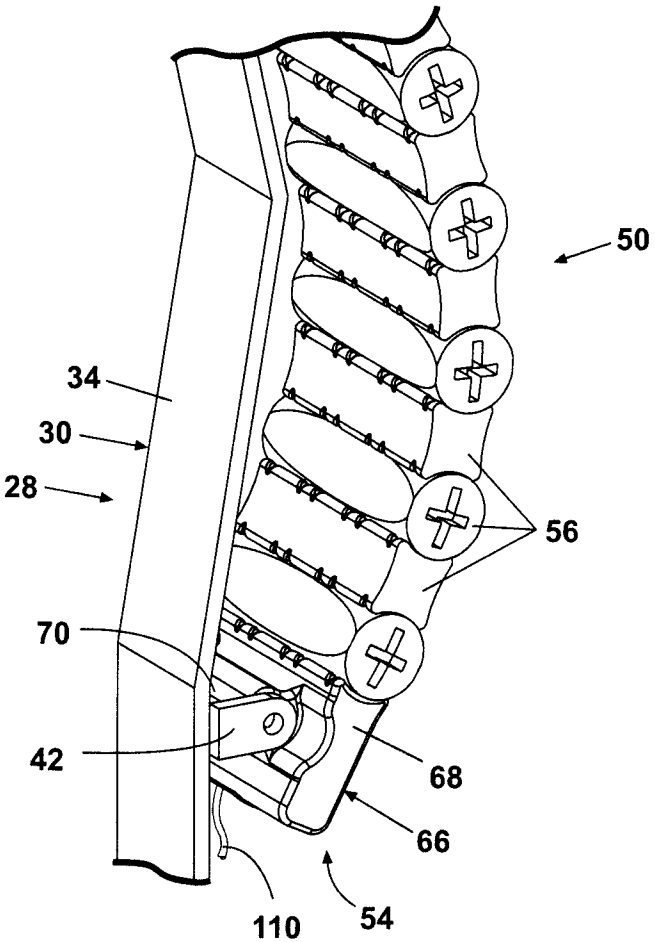
FIG. 3 is an enlarged elevation view of a lower section of the back support assembly contained within circle III shown in FIG. 1.
Figure 2:
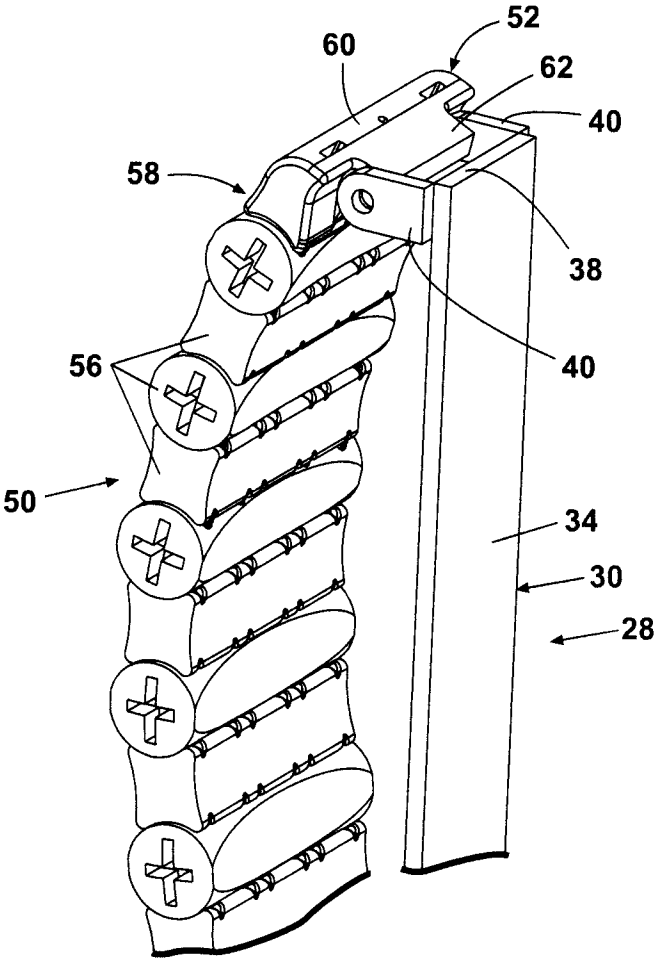
FIG. 2 is an enlarged elevation view of an upper section of the back support assembly highlighted by circle II shown in FIG. 1.
Figure 4:
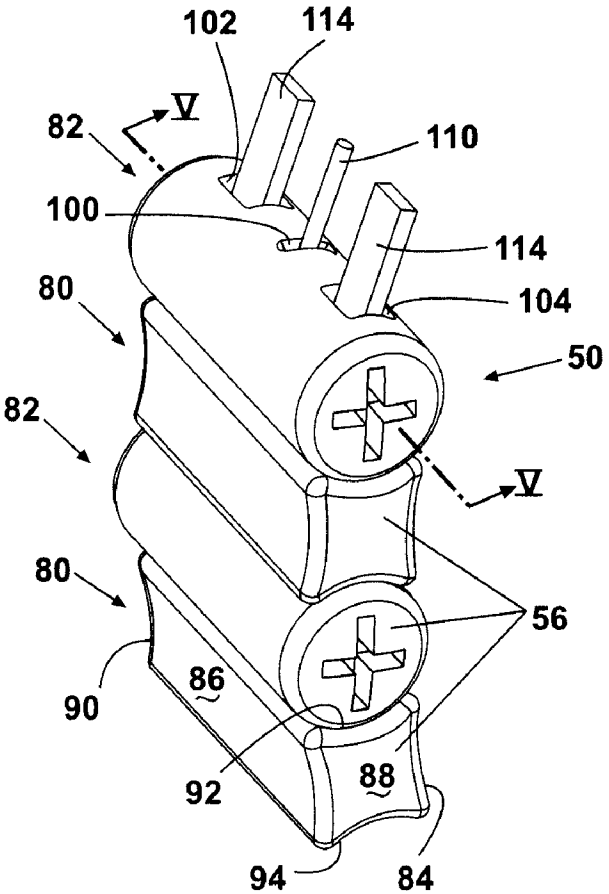
FIG. 4 is an enlarged elevation view of an intermediate section of the back support assembly and generally identified by circle IV shown in FIG. 1.

Another portion of the back support assembly 26 is supported by the frame assembly 28. Referring to FIGS. 2-4, a back assembly 50 of predetermined length is attached to the frame assembly 28. An upper end 52 of the back assembly 50 is attached between the upper yoke-like flanges 40 and an opposite end 54 is likewise attached between the lower yoke-like flanges 42. In a preferred embodiment, the length of the back assembly 50 is greater than the distance between the upper and lower yoke structures 40, 42 to cause the back assembly 50 to bow or arch away a predetermined distance from the upright member 34.

The back assembly 50 is preferably formed from a plurality of back members generally identified by the reference numeral 56. In one embodiment, back members 56 include an upper anchor member 58 defined by a generally body portion 60 and an adjoining coupling block 62 which in the preferred embodiment is received between the upper yoke flanges 40. The coupling block 62 preferably includes a longitudinal hole or passage 64 adapted to align with the holes 44 in the flanges 40. In a similar fashion the back assembly 50 includes a lower anchor member 66 also having a generally solid body 68 attached to a lower coupling block or body 70. The lower coupling body 70 is similarly received between the lower yoke flanges 42 and includes a longitudinal passage 72 adapted to be aligned with the holes 44 in the flanges 42 to receive a bolt or other type of fastener (not shown). The coupling arrangement between the respective upper and lower coupling bodies or blocks 62 and 70 with the flanges 40 and 42 permit the back assembly 50 to pivot at each end to allow the back assembly to conform to the contour of an occupant as will become more readily apparent below.

Figure 5:
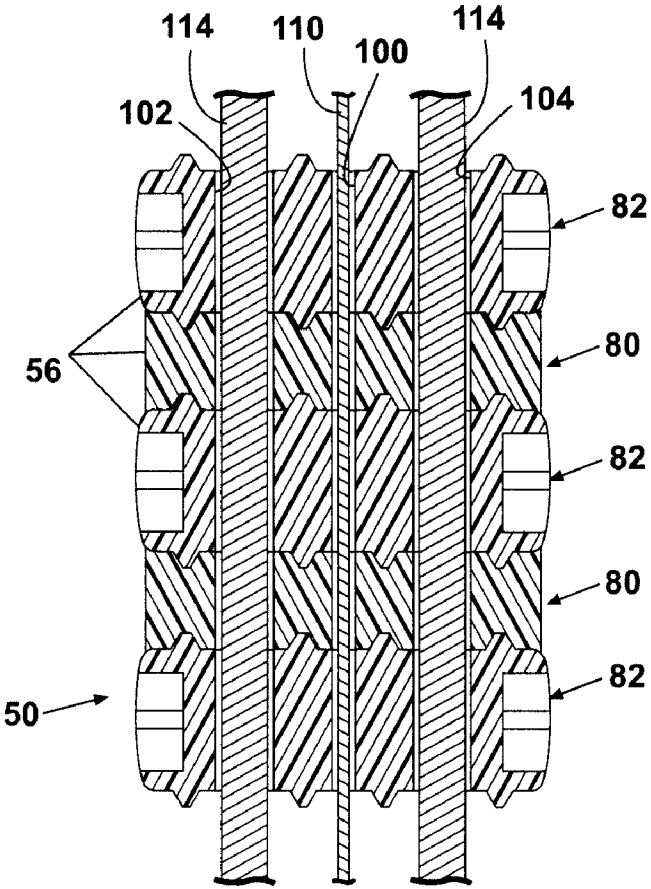
FIG. 5 is a section view of the back support assembly shown in FIG. 2.

Intermediate the upper and lower anchor members 58 and 66 are a plurality of back elements or members 74, each juxtaposed one another vertically. See FIG. 4. Each of the back elements 74 is able to articulate within a predetermined range of angular arc relative to an adjacent back element 74 so that the back assembly 50 may conform to a substantially any serpentine shape. FIGS. 4 and 5 illustrate one embodiment of the back elements 74 in greater detail.

In a first embodiment, back elements or members 74 may include a first member 80 and a second member 82. As illustrated, each first member 80 may be in the form of a generally polygonal or semi-cylindrical form of predetermined dimension and my have generally parallel surfaces 84 and 86, and opposing ends 88 and 90. Upper and lower surfaces or ends 92 and 94 may include opposing longitudinally concave surfaces of predetermined radius generally complimentary to that of the juxtaposed second member 82. The second member 82 may also be in the form of a polygon or cylindrical solid of predetermined dimension generally similar in terms of width and length as that of each first member 80. The shape or form of the curved surface of the second member 82 is preferably similar to the shape of the concave surfaces formed in the ends 92 and 94 of the first members 80, but need not be exact with the intention to create as much friction as possible between the first and second members at certain times while in use. A few ways for creating such interference will be described in greater detail below.

Although the first and second members 80 and 82 have been described above, it is anticipated that other shapes and forms may be used including various oblate and prolate ovals, spheroids, and polygons so long as there is sufficient surface area between the two components to provide an interference or frictional surface for reasons that will be become more readily apparent below. It is also anticipated that different materials may be implemented to form the different members 80, 82 to increase the interference or frictional interaction and locking function in a first configuration while at the same time permitting relatively easy movement between the support members in a second configuration. A variety of modifications described in greater detail below are designed to help achieve that function.

As seen best in FIG. 5, first members 80 and second members 82 may be substantially solid but for several passages extending transversely there through. Although we have shown them as being substantially solid, they need not be, and could be formed from a networks of bulkheads and other interior framework to provide rigidity. But with respect to what is shown, each back support member 56 includes a central passage 100 that passes entirely through each member 56 and configured to substantially align with a similar passage 100 formed in an adjacent member 56. In this embodiment it is also envisioned that two outboard passages 102 and 104 also extend through each member 56 outboard of and parallel to central passage 100. The upper and lower throats of each passage within each member 56 are preferably larger in terms of lateral dimension that in the center of each member 56 for reasons provided below but it is also anticipated that the dimensions may be constant throughout. The wider throats toward each end of each passage 100, 102 and 104 provides greater leeway in aligning the passages in the adjacent support member when one rotates relative to one another.

No direct linking or coupling is required to keep adjacent back members together. Rather the plurality of back members 56 may be threaded on a clamping or tensioning member 110 such as, but not restricted to, a cable, strap, or rod extending through each back member 56. The uppermost end of the clamping or tensioning member 110 is anchored in one of the anchoring members 58, 66 described above. The opposite end of the clamping or tensioning member 110 is preferably coupled to a tensioning apparatus or device 112 (FIG. 1) attached to a fixed structure such as one of the frame assembly 28, the seat assembly 24 or the base assembly 22. Together, the clamping or tensioning member 110 and the tensioning apparatus or device 112 comprises the clamping assembly. In a preferred embodiment, the tensioning device 112 may be fixed to the frame assembly such that any tension applied to the member 110 places the back support members in compression in a first configuration, creating substantial loads between the pluralities of back members 56 along the mating surface areas described above. In a second configuration of the tensioning device, tension on the member 110 is relieved, allowing the back members 56 to disengage from one another, and rebound through pivoting or relative movement to one another. The tensioning member 110 may be adjusted to place any desired degree of tension on the back member 56 to suit the user's preference as to stiffness. That is to say the tensioning member 110 may be adjusted anywhere between no tension and full tension to provide the desired stiffness in the back member 56. Any one of a number of different forms of tensioning devices 112 may be utilized to adjust the amount of tension applied to member 110. Examples of such devices include threaded wheels, ratcheting drums, over center levers and linkages, cam tensioning devices, as well as a host of others.

Extending through each of the respective outboard passages 102 and 104 is a resilient biasing assembly 114 having a predetermined spring constant. The biasing assembly 114 may formed from one or more resilient members or springs 116 to provide lateral or rotational rigidity to the back support assembly 26, yet also absorb and provide flexibility in some measured degree to the contour of the back. In the embodiment depicted in the drawing figures, two resilient members or springs 116 are depicted on opposite sides of the tensioning member 110. However it is envisioned that a single resilient member or spring such as 116 may be used. In that scenario it is contemplated that the tensioning member 110 may be located slightly off-center along with the one resilient member or spring 116 to provide as much of the forces toward a centerline of the back member 56. It is also envisioned that if more than one resilient member or spring is being used, it may be desired to place the springs 116 as far outboard as possible, depending upon the chair design. Regardless of the location of the springs or resilient members 116, it is desired that the members 116 apply a biasing force to the back. This way, the user is able to sit in the seat and apply sufficient force to allow the back assembly 50 to conform to the occupant's back contour. This also provides the user the option to fix the contour should it be desired by increasing the tension on the tensioning member 110, placing each of the plurality of back members 56 into compression and a locked position. In one form of the invention it is envisioned that the resilient members 116 may be in the form of rods, blades, tubes or coils of metallic or polymeric material providing sufficient spring constant to apply a biasing force to each of the back support members displaced from its original position. Other forms, shapes, and materials for the resilient members 116 may be used to apply the desired biasing forces to the back.

Figure 6:
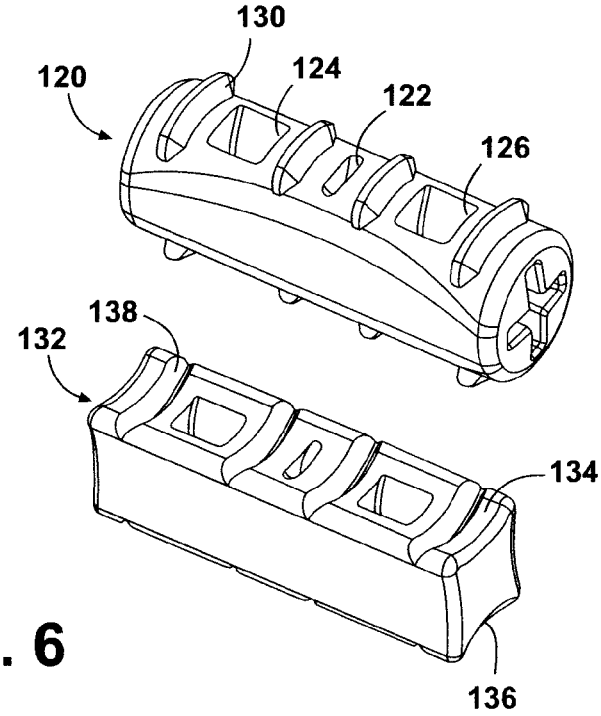
FIG. 6 is an oblique view of one embodiment of back members contemplated for use in the invention.

FIG. 6 illustrates another embodiment of the back members 120 that may be used to form the back assembly 50. Each back member 120 may be in the general form of a cylinder of predetermined radius. It is envisioned that each back member 120 may also be tubular or solid in form so long as each provides sufficient surface area to interact with the juxtaposed back member 120 when placed in compression. The length of each back member 120 is predetermined as well and just like the previous embodiment, includes a central passage 122 and outboard passages 124 and 126 of predetermined dimension. As in the previous embodiment, the dimensions of the passages may be constant throughout although it is also anticipated that the throats at each end may be greater than the lateral dimensions of the passage intermediate the ends.

Figure 7:
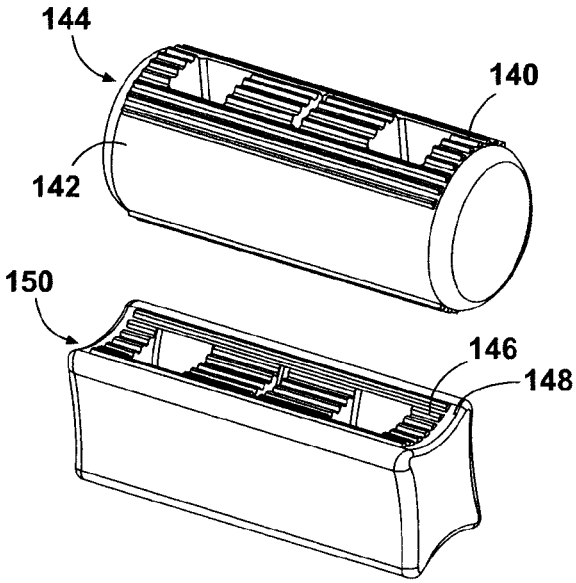
FIG. 7 is an oblique view of another embodiment of back members contemplated for use in the invention.
Figure 8:
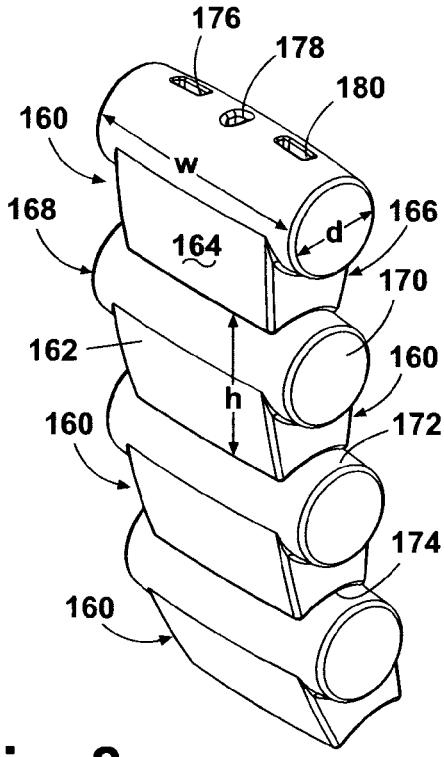
FIG. 8 is an oblique view of yet another embodiment of back members contemplated for use in the invention.

To increase the frictional locking force between the back members 120, the surface area around the circumference 128 may be increased by providing topography or interference structures. In one embodiment the interference structures may be in the form of a plurality of circumferential or annular ridges 130 spaced at predetermined intervals along the length of each member 120. The profile of each interference member 130 may vary depending upon the desires of the manufacturer, but in a preferred embodiment, each may have a triangular cross-sectional profile of predetermined pitch and height. The corresponding and mating member 132 shown in FIG. 7 may also include a corresponding mating interference profile defined in the upper and lower ends 134, 136, respectively. As shown in FIG. 7, the upper end 134 includes a longitudinal concave profile in which are defined a like number of transverse interference structures such as grooves or channels 138. The pitch profile of each structure 138 may be slightly different from that of a mating structure 130 so that when placed in compression relative to one another, each structure or member 130 is wedged into a receiving or corresponding structure 138, providing a good frictional lock between the two components. It has been found that the addition of the plurality of annular structures 130 and their interaction with the structure or member 138 provides additional rotational rigidity than the use of purely cylindrical frictional interfaces.

Based upon the suggested description made above with respect to FIG. 6, other surface area modifications or adaptations can be made between the interacting back members 56 to increase the frictional interference characteristics as well as reduce torsional motion or movement. For example as shown in FIG. 7, one such alteration may include providing longitudinal splines 140 about the circumferential surface 142 of a cylindrical member such as 144. Like longitudinal mating splines, grooves or the like 146 may be formed in the longitudinal trough or concave end 148 of a mating first member such as 150. Other modifications are contemplated as well, including providing a plurality of mating facets or surfaces on the back support members that act to index the degree of angular arc each back support member may travel relative to an adjacent back support member. The faceted faces may also serve to increase the frictional surface area as well as resist torsional or rotational movement of the back support members relative to one another. Other topical treatments or relief may be used on the interacting surfaces of the juxtaposed back support members, including, but not limited to, a plurality of interacting detents, dimples and pimples, cams and cam followers, ridges and grooves, among others, to provide increased surface area as well as structural interlocking.

It is anticipated that rather than having two dissimilar back support members such as described above, a plurality of like back members such as generally identified by reference numeral 160 may be used to achieve substantially the same function in substantially the same way to achieve substantially the same result without seriously departing from scope and objects of the invention. Referring to the drawing figure, it is anticipated that each back member 160 may include a body 162 having a width (w), a height (h), and a depth (d). The body 162 may be generally rectangular having generally parallel front and back surfaces 164, 166, generally parallel opposing end surfaces 168, 170, and roughly parallel top and bottom surfaces 172, 174, respectively, although just as described above, other forms may also be adopted without departing substantially from the objects of the invention. In the embodiment depicted, the top surface 172 may be convex. The bottom surface 174 may be concave in a shape substantially complimentary to the convex shape of surface 172 of a lower back support member 160.

It is further contemplated that in one embodiment, it may be preferred that every back member 160 be substantially identical to the one above and/or below in order to reduce the number of different components needed to carry out the invention. However, depending upon the desired profile or contour to be adopted by the back support assembly it may be desired to alter the dimensions in terms of height (h), width (w), or depth (d) of one or more back members 160 in order to alter the profile of the back.

Each back member 160 may further include at least one, and preferably a plurality of through passages such as 176, 178 and 180. Passage 176, 178 and 180 are intended to extend from the upper surface 172 downwardly parallel to the height axis of the body 162 and out the bottom surface 174. In a first form, each passage 178 passes along a central axis through each member, while the outboard passages 176 and 180 parallel the central passage, but a predetermined distance laterally offset from the central passage 178. In one form of the invention the diameter or dimension of the passages 176, 178 and 180 may be constant throughout their length. The passages 176, 178 and 180 may have an hour-glass or other vertical profile such that proximate the top and bottom surfaces 168, 170. the dimensions are greater than the dimension of the passages near the center of the body 162 to provide an easier transition to the same passage in an adjoining or juxtaposed back support member.

Similar to that described above, passage 178 of each back support member is intended to receive a clamping or tensioning member such as 110 therein that extends a predetermined length of the back support assembly. In one form, the tensioning member may include substantially any structure that can be placed under a tensile load such that the opposite force places the respective back support members under compression. Acceptable tensioning member structures include metal or polymeric twist or braided cable, polymeric braided cable or ropes, metal and polymeric solid rods and straps, or substantially any other type of material capable of being placed under tension. The biasing passage(s) may receive any one of a number of members capable of providing a restoring force to the back support. Such restoring forces may be provided by biasing members in the form of cables, rods, straps, blades, and coiled springs. Other structures may also be used to provide the restoring or biasing force without departing substantially from the scope and objects of this invention.

In operation, it is envisioned that to adjust the back assembly 26 to fit the contour of the occupant, the tensioning device 112 is placed in a release configuration removing any axial compressive forces upon the juxtaposed back support members. The degree of release may be adjusted to range from where the return springs just overcome the compressive force so that the biasing force of the springs just overcomes the compressive force on a limited number of back support members, to a point where all compression is removed, allowing the springs to move all of the back support members to an initial bowed or arched position relative to the frame assembly. In a preferred embodiment, it is anticipated that the invention will be tuned at the time of manufacture so that when the tensioning device is released, the occupant may lean against the back assembly 50 and have the back members articulate or pivot about axes of rotation contained in an adjacent back support member to allow the back assembly to bend and shape to the serpentine contour of the user's back without a complete collapse. Moreover, it is anticipated that the spring constant of the return springs will also provide a substantial amount of resistive force to keep the occupant from feeling like he/she is falling back in the seat. The resistive force applied by the spring will also aid in redistributing the forces to cause the back support assembly conform to the shape of the user. Once the desired profile has been established by the user in the seat, the occupant simply move the tensioning device 112 to a second or locking position. Actuation of the tensioning or locking device 112 places the cable or tensioning rod 110 in tension. This action places an equal and opposite reaction upon the plurality of back support member, causing them to compress against one another along the line of the profile adopted from the occupant. As the back support elements compress, the frictional surfaces produced by the mating concave and convex surfaces provide ample force to keep the back assembly at the established profile. It is also envisioned that structure be added behind the back assembly to keep the assembly from oil canning in the opposite direction. Such a structure may include a limiter on the degree of movement of the back assembly in a direction toward the frame. The tensioning device may be adjusted to place any desired degree of tension on the back member to suit the user's preference as to stiffness as more fully described below.

Figure 9:
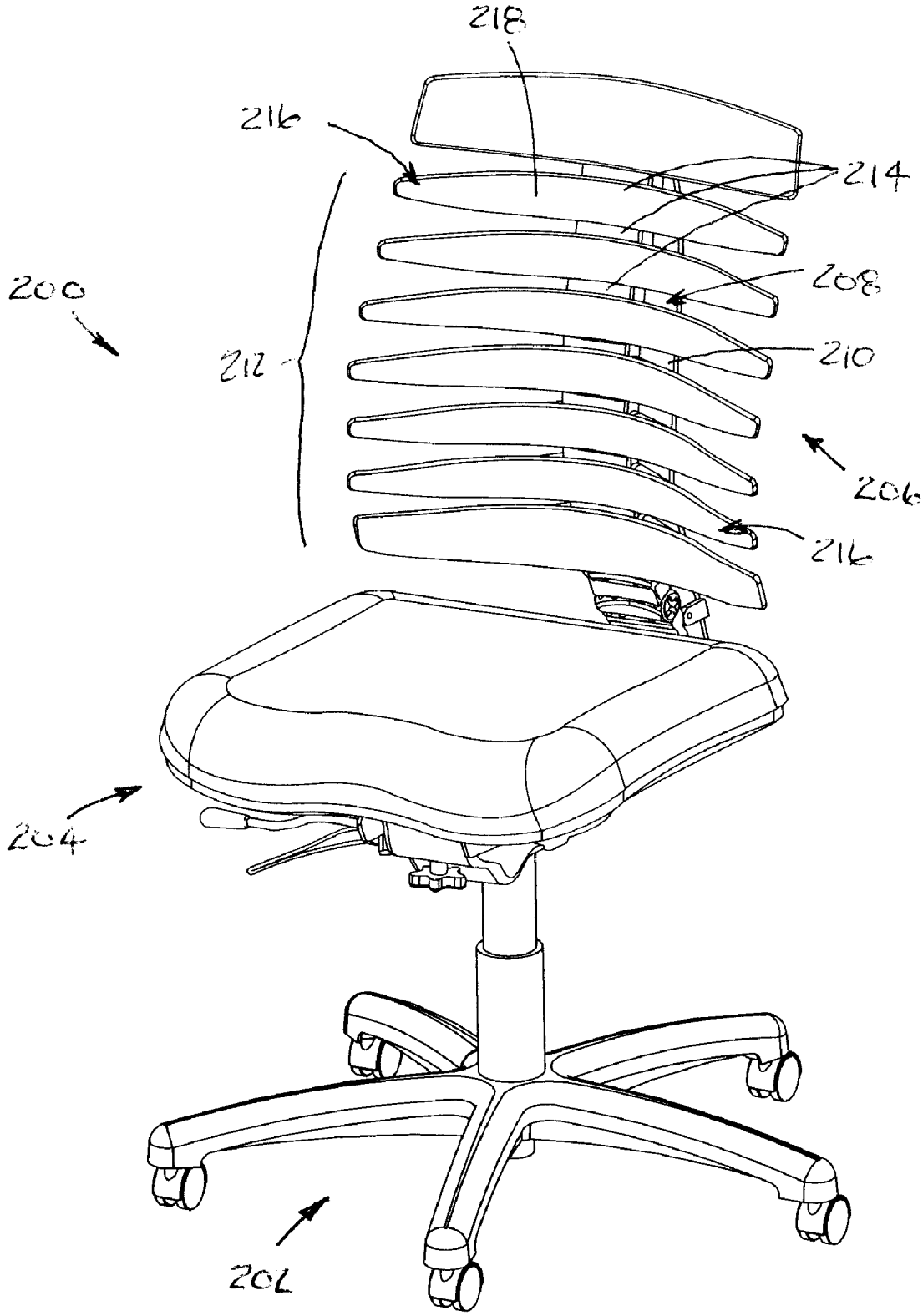
FIG. 9 is an oblique view of a seat employing another embodiment of a back support assembly.
Figure 10:
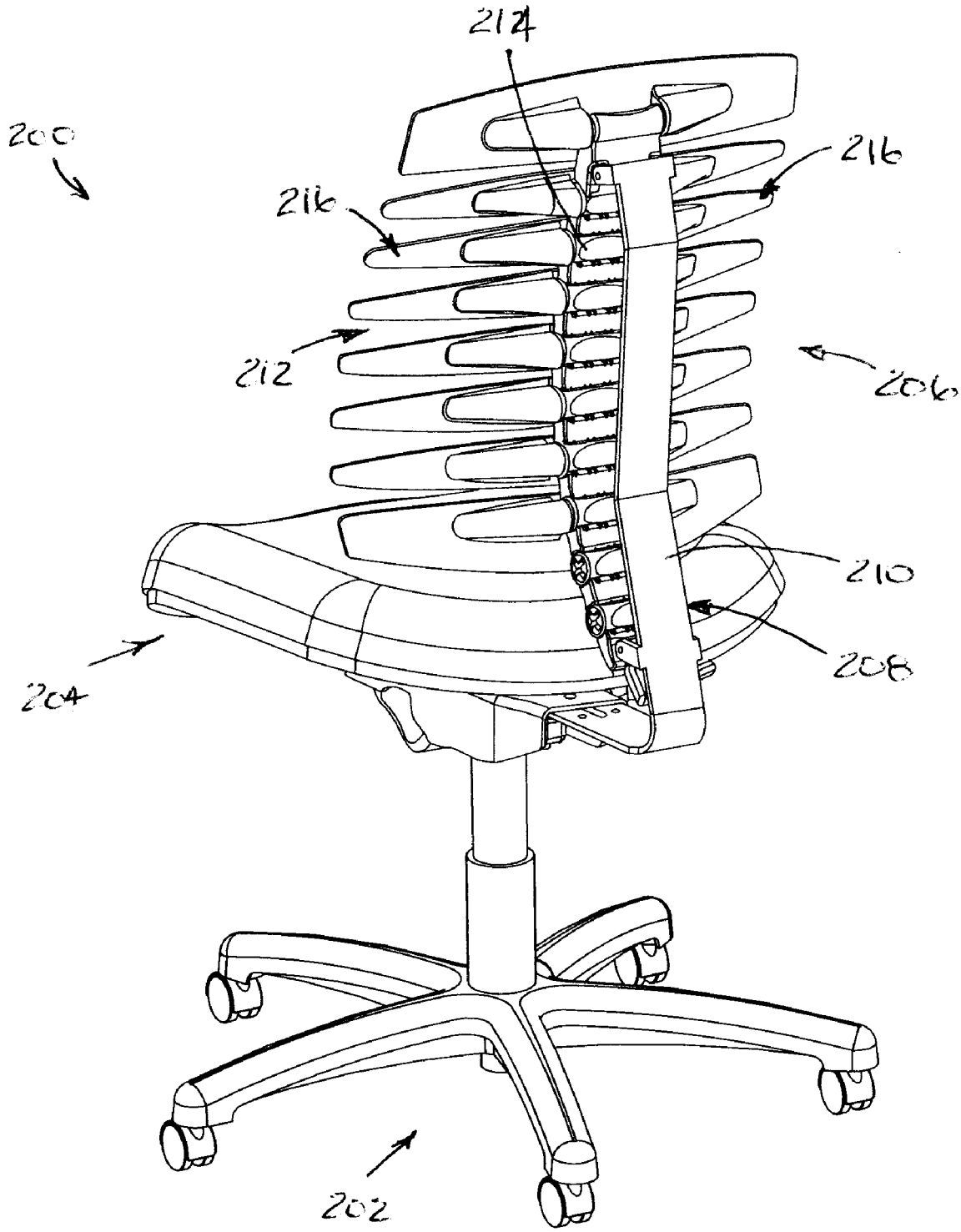
FIG. 10 is an oblique view of the seat shown in FIG. 9 from another angle.
Figure 11:
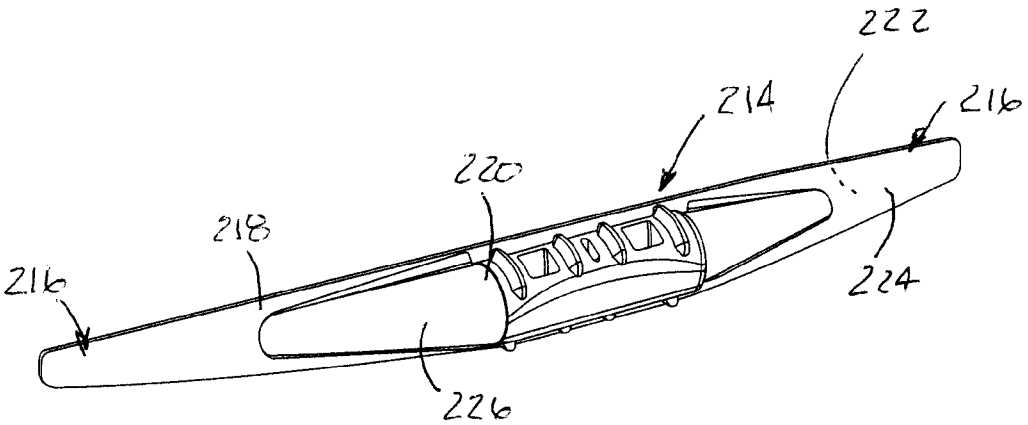
FIG. 11 is an oblique view of a back element shown in FIG. 10.

FIGS. 9 and 10 illustrate another embodiment of a seat 200 including a base assembly 202, a seat assembly 204, and a back support assembly 206 offering the same novel features, advantages and benefits of the previously described embodiments, offering lateral support for the back of the user. Similar to the prior embodiments, the back support assembly 206 includes a frame assembly 208 formed from a frame member 210 which is dependent from one of the base assembly 202 or the seat assembly 204, and extends upwardly therefrom. Mounted intermediate an upper and lower end of the frame assembly 210 is a back assembly 212 assembled from a plurality of back members 214 disposed in serial arrangement one adjacent another. Each back member 214 may generally be in the form of a cylinder and disposed relative to an adjacent member 214 such that the cylindrical sides may be tangentially in contact with one another.

As best seen in FIG. 10, extending from opposite ends of each back member 24 is a lateral support 216, each of which may vary in terms of length, width, and thickness, depending in large part upon the vertical location along the back assembly 212, as well as the extent and amount of support desired. For example, lateral supports 216 that are thicker, wider and longer provide support over a greater area than supports 216 that are shorter, thinner, and narrower. The arrangement of the lateral supports 216 along the back support assembly 206 may vary depending upon the desired support characteristics one wishes to achieve. In a preferred embodiment, each lateral support generally includes a blade section 218 of predetermined length and width extending from a root section 220 designed to transition with an end of a back member 214. Transitioning outwardly from the root section 220, the blade section widens to a predetermined width forming a front surface 222 and a back surface 224. The thickness of the blade section may vary, but it is envisioned, depending upon the type of material used in the manufacture, that each blade section may run between one-eighth and one-quarter of an inch thick. The flexibility of each blade section may also be controlled by a flexor or rib member 226 extending along the back surface parallel to the length of the blade, beginning at the root section and extending a predetermined distance along its length. In a preferred embodiment the flexor or rib member 226 is formed integrally with the blade section. The width or thickness of the flexor member may vary along the length of each blade to provide the desired amount of flexion in each support.

As seen in FIGS. 9 and 10, not every back member 214 need have lateral supports extending from each end. Indeed, if lateral supports offering wide support in the vertical direction are used, fewer lateral supports may be desired to reduce interference with one another. On the other if support to a greater degree is desired, the manufacturer may reduce the vertical extent of each lateral support, narrowing them so that a greater number may be used. The lateral supports may be formed separately from each of the back members and attached to the ends of the members using one or more of a host of connection methods. These include male/female connections, mechanical fastening, and adhesives. Alternatively it may be desired to manufacture each back member and lateral support as a single integral unit reducing the time for manufacture and removing any inherent weakness in the transition.

Figure 12:
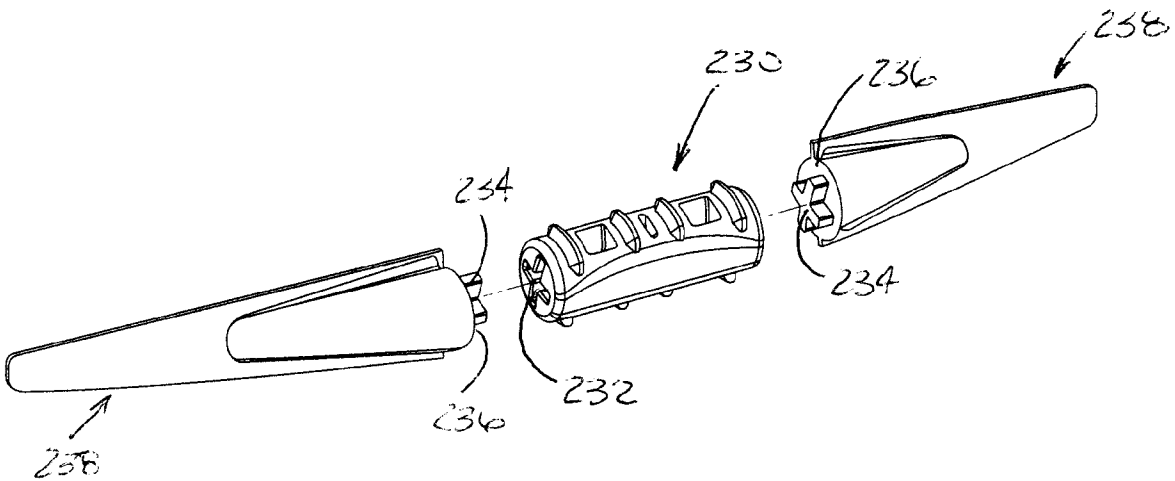
FIG. 12 is an oblique exploded view of another embodiment of a back element contemplated for use in the invention.

Although the above description describes the lateral supports 216 as being formed integrally with select ones of the back members, it is envisioned that the back members may have couplers formed at opposite ends for having select lateral supports attached thereto to form a custom back support. For example as shown in FIG. 12, a back member 230 may have a recess 232 formed in opposite ends thereof which are configured to receive a male member 234 extending from an end 236 of each lateral support 238. The male member 234 extending from the lateral support 238 may be one of any number of designs or shapes to provide a secure coupling yet offering the desired orientation relative to the back member. It should be immediately recognized that the respective coupling members may be reversed to obtain substantially the same result. Other types of coupling arrangements may be selected to allow custom positioning of the lateral supports on the back members, yet ensuring that the attachment of each lateral support to a respective back member is secure and able to remain attached to the back member during use.

It may be desired to cover or conceal all or portions of the back support assembly with a mesh, a fabric, and leather or vinyl skin. Depending upon the actual shape and design of the frame assembly, the cover may enclose the frame assembly, or leave it exposed, depending upon the style or design intended by the manufacturer. In one particular embodiment, it is envisioned that the cover enclose just the back assembly and those portions of the frame assembly where the back assembly is connected, leaving the framework for the frame assembly exposed as part of the design. Depending upon the specific configuration of the back support assembly and its spatial relationship with the seat assembly, other covers and concealments may be designed that provide an aesthetic appearance or particular design characteristic.

It is currently envisioned that the individual back support member described above and the variants described above may be manufactured from a variety of materials, including resin and other polymeric materials, metals and their alloys, as well as wooden based products. However it is preferred that the back support members be made using injection molding techniques from resins and other polymers to achieve the preferred durometer hardness for maximizing the frictional locking forces when in the compressed state. Injection molding also provides the user the most efficient mechanism for obtaining the varieties of profiles and structures described above.

In the foregoing description, it will be readily appreciated by those skilled in the art that modifications may be made to the invention without departing from the concept disclosed herein. Such modifications are to be considered as included in the following claims, unless these claims by their language expressly state otherwise.

We claim:

1. A seat, comprising:

a base assembly;

a seat assembly interconnected to said base assembly;

a frame assembly extending upwardly from one of said base assembly and said seat assembly and providing a substantially rigid structure a back support having a first end coupled to a first end of said frame assembly, and a second end coupled to a second end of said frame assembly, said back support including a plurality of back support members intermediate said first and second ends of said frame assembly, each of said plurality of back support members having a longitudinal surface engaging a longitudinal surface of an adjacent back support member;

a clamping assembly extending through each of said back support members and interconnecting said first and said second end of said frame assembly for placing said plurality of back support members in and out of compression relative to one another and fixing a relative position of each back support member relative to an adjacent back support member; and at least one biasing member disposed within said back support for providing a resistive and restoring force to said plurality of back support members.

2. The seat as defined in claim 1, wherein said plurality of back support members further include a plurality of transverse passages for receiving at least one of said clamping assembly and said at least one biasing member there through.

3. The seat as defined in claim 2, wherein said plurality of transverse passages include at least one central passage, and a least one outboard passage generally parallel to said at least one central passage.

4. The seat as defined in claim 1, wherein said longitudinal surface of each of said plurality of back support members include one of ridges and channels adapted to engage a corresponding opposite structure in an adjacent back support member.

5. The seat as defined in claim 1, wherein said longitudinal surface of each of said plurality of back support members further include a plurality of longitudinal splines.

6. The seat as defined in claim 5, wherein said plurality of splines on each back support member are adapted to engage splines on a juxtaposed back support member.

7. The seat as defined in claim 1, wherein said longitudinal surface of a first plurality of said back support members further include at least one of a groove and ridge disposed at an angle to said longitudinal surface.

8. The seat as defined in claim 7, wherein said at least one of a groove and ridge includes a truncated triangular-shaped cross section.

9. The seat as defined in claim 7, wherein said longitudinal surface of a second plurality of said back members include at least one of a mating groove and ridge.

10. The seat as defined in claim 7, wherein said at least one of a groove and ridge includes a generally triangular-shaped cross section.

11. The seat as defined in claim 1, wherein a first plurality of said back support members include at least one convex surface.

12. The seat as defined in claim 1, wherein a first plurality of said back support members include at least one concave surface.

13. The seat as defined in claim 1, wherein a first plurality of said back support members include circular cylindrical bodies.

14. The seat as defined in claim 1, wherein a first plurality of said back support members include rectangular solid bodies.

15. The seat as defined in claim 1, wherein a first plurality of said back support members include polygonal solid bodies.

16. The seat as defined in claim 1, wherein a first plurality of said back support members include at least two opposing concave surfaces.

17. The seat as defined in claim 1, wherein said clamping assembly includes one of a cable and rod.

18. The seat as defined in claim 17, wherein said clamping assembly extends through an intermediate portion of said plurality of back members.

19. The seat as defined in claim 12, wherein said clamping assembly extends through an end portion of said plurality of back members.

20. The seat as defined in claim 1, further including means for placing said clamping assembly under tension and pulling said second end of said frame assembly toward said first end of said frame assembly.

21. The seat as defined in claim 1, wherein said at least one biasing member includes one of a leaf spring, a coil spring, a rod spring, and a blade spring.

22. The seat as defined in claim 1, further comprising a plurality of lateral support members extending from a plurality of said plurality of back support members.

23. The seat as defined in claim 1, wherein said at least one biasing member is disposed laterally relative to said clamping assembly.

24. The seat as defined in claim 1, further comprising a lateral support extending from each end of one or more of said back support members.

25. A back assembly for a seat, comprising:

a substantially rigid frame assembly adapted to be connected to one of a seat assembly and a base assembly of the seat, said frame assembly having an upper end and a lower end;

a back support assembly having a length greater than said frame assembly, said back support assembly disposed between said upper end and said lower end of said frame assembly, said back support assembly comprising a plurality of back members juxtaposed serially to one another and in contact with adjacent ones of said back members a tensioning assembly extending through each of said back members for selectively placing said plurality of back members in and out of compression relative to one another; and at least one biasing member extending through each of said back members for providing a resistive and restoring force to said back support assembly.

26. The back assembly for a seat as defined in claim 25, further comprising lateral supports extending from opposite ends of said back members.

27. The back assembly as defined in claim 25, wherein said frame assembly comprises:

a first leg member attached to one of a seat assembly and a base assembly of the seat, and a second leg member extending generally upright from said first leg member; and first and second coupling flanges disposed at opposite ends of said second leg member.

28. The back assembly as defined in claim 27, wherein said back support assembly further comprises:

an upper anchor member for attaching said back support assembly to said first coupling flange; and a lower anchor member for attaching said back support assembly to said second coupling flange.

29. The back assembly as defined in claim 28, wherein said plurality of back members further comprises:

a first plurality of back members disposed intermediate said upper anchor member and said lower anchor member; and a second plurality of back members disposed intermediate said upper anchor member and said lower anchor member and juxtaposed in alternating linear spaced relationship to said first plurality of back members.

30. The back assembly as defined in claim 28, wherein said plurality of back members are substantially similar to one another, wherein each of said plurality of back members includes one of a convex surface and a concave surface.

31. The back assembly as defined in claim 28, wherein said back support assembly further comprises interference structures defined on said back members.

32. The back assembly for a seat as defined in claim 25, wherein each of said back members comprises:

a body including one of a convex and a concave surface for engaging in arcuate sliding relationship one of a convex and a concave surface of an adjacent back member; and a plurality of passages extending through said body of each back member for receiving said at least one of a biasing member and said tensioning assembly.

33. The back assembly for a seat as defined in claim 32, wherein each of the back members further comprises at least one interference structure defined on one of said convex and said concave surface of said body.

34. The back assembly for a seat as defined in claim 32, wherein each of the back members further comprises a width of said body being greater than a height of said body and said height being greater that a depth of said body.

35. The back assembly for a seat as defined in claim 32, wherein each of the back members further comprises a lateral support extending from each end of said body.

36. A back support assembly for a seat, comprising: a substantially rigid frame assembly adapted to be connected to one of a seat assembly and a base assembly of the seat, said frame assembly having an upper end and a lower end; a back support assembly having a length greater than said frame assembly, said back support assembly disposed between said upper end and said lower end of said frame assembly, said back support assembly including a plurality of back members juxtaposed serially to one another and in contact with adjacent ones of said back members, each including at least one of a convex and a concave surface; each of said plurality of back members having one of said convex and said concave surface that moves along one of said convex and concave surface of a juxtaposed back member; a tensioning assembly extending through each of said back members for selectively placing said plurality of back members in and out of compression relative to one another; and at least one biasing member extending through each of said back members for providing a resistive and restoring force to said back support assembly.

37. A self adjusting back support assembly for a seat, comprising: a rigid frame member adapted to be connected to one of a seat assembly or a base assembly of the seat and having a first end and a second end; a back support assembly having a length greater than said frame assembly, said back support assembly disposed between said first end and said second end of said frame member, said back support assembly including a plurality of pivotally adjustable back members juxtaposed serially to one another and in contact with adjacent ones of said pivotally adjustable back members, intermediate said first end and said second end of said rigid frame member, each of said back members including one of a convex and a concave surface in sliding engagement with one of a convex and a concave surface of a juxtaposed back member, allowing the back support assembly to adopt a serpentine contour substantially following a contour of an occupant's back; a tensioning assembly extending through each of said pivotally adjustable back members for selectively placing said plurality of pivotally adjustable back members in and out of compression relative to one another; and at least one biasing member extending through each of said pivotally adjustable back members for providing a resistive and restoring force to the back support assembly.

* * * * *

UNITED STATES PATENT AND TRADEMARK OFFICE

CERTIFICATE OF CORRECTION

PATENT NO. : 7,909,402 B2
APPLICATION NO. : 12/211453
DATED : March 22, 2011
INVENTOR(S) : Zooey C. Chu et al.

It is certified that error appears in the above-identified patent and that said Letters Patent is hereby corrected as shown below:

On the Title page of the patent, the inventor's name "Ju; Shun Lie" should read --Lu; Shunjie--.

Signed and Sealed this
Thirty-first Day of May, 2011

David J. Kappos

David J. Kappos
*Director of the United States Patent and Trademark Office*